United States Patent [19]

Woron

[11] 4,134,321

[45] Jan. 16, 1979

[54] DEMULTIPLEXING AUDIO WAVESHAPE GENERATOR

[75] Inventor: Robert P. Woron, Allentown, Pa.

[73] Assignee: Allen Organ Company, Macungie, Pa.

[21] Appl. No.: 787,696

[22] Filed: Apr. 14, 1977

[51] Int. Cl.[2] ..... G10H 1/00; G10H 5/00

[52] U.S. Cl. ..... 84/1.22; 84/1.19; 84/1.24; 84/DIG. 2; 84/DIG. 9

[58] Field of Search ..... 84/1.01, 1.03, 1.11, 84/1.19, 1.22, DIG. 2, DIG. 9, 1.24

[56] References Cited

U.S. PATENT DOCUMENTS

| | | | |
|---|---|---|---|
| 3,610,799 | 10/1971 | Watson | 84/1.01 |
| 3,746,773 | 7/1973 | Uetrecht | 84/1.01 |
| 4,018,125 | 4/1977 | Nishimoto | 84/1.19 |
| 4,041,826 | 8/1977 | Oya | 84/1.01 |

*Primary Examiner*—Stanley J. Witkowski
*Attorney, Agent, or Firm*—Seidel, Gonda & Goldhammer

[57] ABSTRACT

In an electronic musical instrument a demultiplexing audio waveshape generator, which accepts multiplexed frequency signals and generates a complex audio waveshape. This is accomplished by having a multiplexed frequency source with one or more outputs with each output being individually connected to a weighted resistor. The outputs of the resistors are connected in common to create a current source for presentation to an analog switch. The analog switch selects the multiplexed channels to be combined to produce the audio output signal, and through the use of gating signals can be made to create pulsed waveshapes. In the preferred embodiment of the present invention the signal from the analog switch is presented to a capacitance-resistance combination. The switched current presented to the capacitor causes an incremental charging and discharging of the capacitor which corresponds to the desired contribution of that particular channel to the audio output signal. The capacitance-resistance combination also functions as a low-pass filter to smooth the waveshape and provide some formant filtering.

11 Claims, 13 Drawing Figures

DEMULTIPLEXING AUDIO WAVESHAPE GENERATOR

BACKGROUND OF THE INVENTION

1. Field of the Invention

This invention resides broadly in the field of electronic musical instruments and is particularly adaptable for use in instruments employing a time-division multiplexed signal for calling forth desired tones from those available to be produced by the instrument. The principles of the present invention are applicable to any electronic musical instrument in which musical sounds are generated in response to the actuation of key switches regardless of whether those switches are actuated directly, e.g., by the musician's fingers, or indirectly, e.g., by the plucking of strings. The term key is used in a generic sense to include depressible levers, actuable on-off switches, touch or proximity responsive devices, closable apertures and so forth. The present invention relates to the generation of the complex audio waveshape of a musical note played on an electronic musical instrument. More particularly, the present invention relates to a demultiplexing waveshape generator for electronic musical instruments.

2. Description of the Prior Art

Heretofore, the art of generating audio waveshapes could be divided into two major groups. The first group and more recent in the art is that group using audio waveshape memories, either digital or analog. Typically a waveshape memory of this type is used to store a plurality of sample points which replicate the desired audio waveshape. Depending upon the system used to construct the instrument, a method of addressing the memory is provided which will read out at the required frequency selected waveshapes from memories in response to the notes called for by the user or player. Circuitry is provided to modify the waveshape as to attack and decay and other desired tonal characteristics all resulting in the final complex audio signal. The second major group in the art is that group using analog audio waveshape generators. The analog instruments are generally of two types, those using one or more discrete oscillators and those using frequency dividers for audio waveshape generation. However, the prior art method of using oscillators does not depend upon the distinction between types. Typically in an analog instrument an oscillator is used to create an audio tone. This can be done with either a free running oscillator or a voltage controlled oscillator. Circuitry is sometimes provided to modify the tone waveshape through use of filters, diodes, etc. to arrive at the desired audio waveshape. Further circuitry provides attack and decay and other desired tonal characteristics all resulting in the final complex audio signal.

The waveshape generators of the abovementioned major groups present a series of technical problems, not the least of which are the cost and the amount of hardware required to produce an acceptable audio waveshape.

Two significant advantages of the instant invention are the simplicity of the circuitry over previous audio waveshape generator systems and the cost effectiveness over previous systems.

SUMMARY OF THE INVENTION

The present invention provides a new and unobvious tone or waveshape generation means which is particularly useful in electronic musical instruments. The present invention provides a significant advantage in that the demultiplexing audio waveshape generator is useful in instruments using digital electronic techniques. Briefly, in accordance with the present invention there is provided an apparatus for generating audio waveshapes in response to key selection by the user or player of an electronic musical instrument. In response to key selection a plurality of multiplexed, octavely related, frequency signals are presented individually to an equal number of weighting resistors, each resistor being connected to only its respective multiplexed frequency signal. Each multiplexed frequency signal consists of a plurality of time division channels. The outputs of the resistors are connected in common for presentation to an analog switch. A sample gating signal synchronized with the respective multiplexed time division channels is provided to control the analog switch. The analog switch, in response to the sample gating signal, selects which of the multiplexed channels are to be combined to form the composite audio signal. Thus, when the analog switch closes in response to the sample gating signal a current proportional to the weighting resistors and the state of their respective driving frequency signals for that channel flows into a capacitance-resistance combination. As a result of this there is developed a voltage increment on the capacitor corresponding to the desired contribution of that channel to the audio waveshape at that particular instant in time. When more than one channel is selected as a result of the sample gating signal, each selected channel contributes a voltage increment to the audio waveshape. Each channel is contributing a replica of the desired waveshape at a frequency dictated by the corresponding channel of the multiplexed frequency signal. Due to the integrating effect of the filter and since the audio waveshape generator multiplex cycle is operating at a frequency much higher than audio frequencies, the result is a composite audio waveshape corresponding to the sum of one or more selected channels.

BRIEF DESCRIPTION OF THE DRAWINGS

For the purpose of illustrating the invention, there are shown in the drawings the forms which are presently preferred; it being understood, however, that the invention is not limited to the precise arrangement and instrumentalities shown.

DESCRIPTION OF THE PREFERRED EMBODIMENT

The following detailed description is of the best presently contemplated modes of carrying out the present invention. This description is not intended in a limiting sense, but is made solely for the purpose of illustrating the general principles of the invention.

Figure 1:
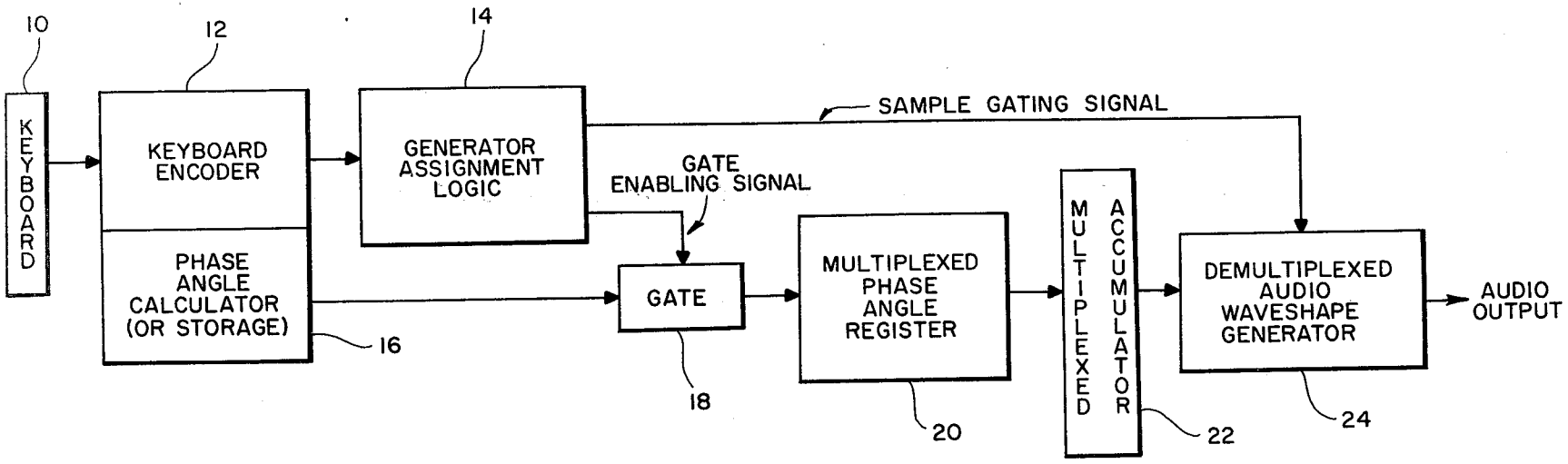
FIG. 1 is a schematic diagram, in block diagram form, of an electronic musical instrument using a demultiplexing audio waveshape generator in accordance with the present invention.
Figure 4:
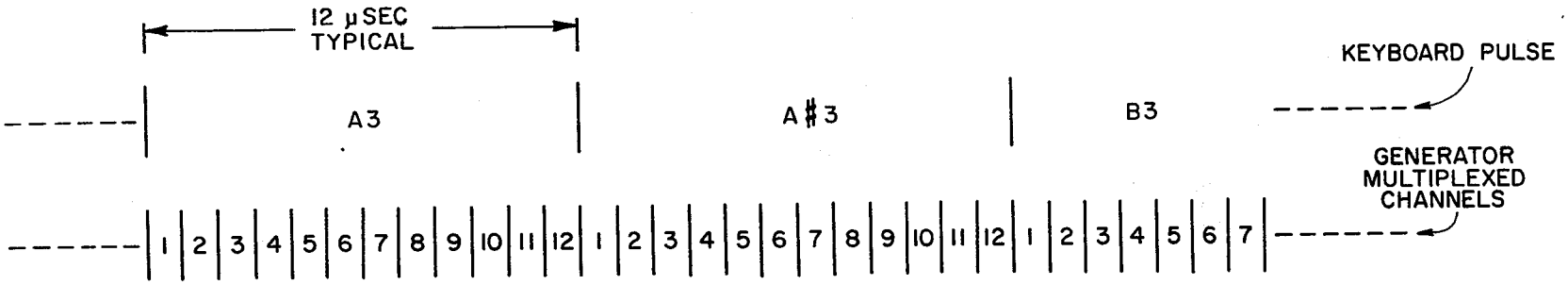
FIG. 4 is a graphic representation of a typical arrangement of multiplexing time slots.
Figure 5:
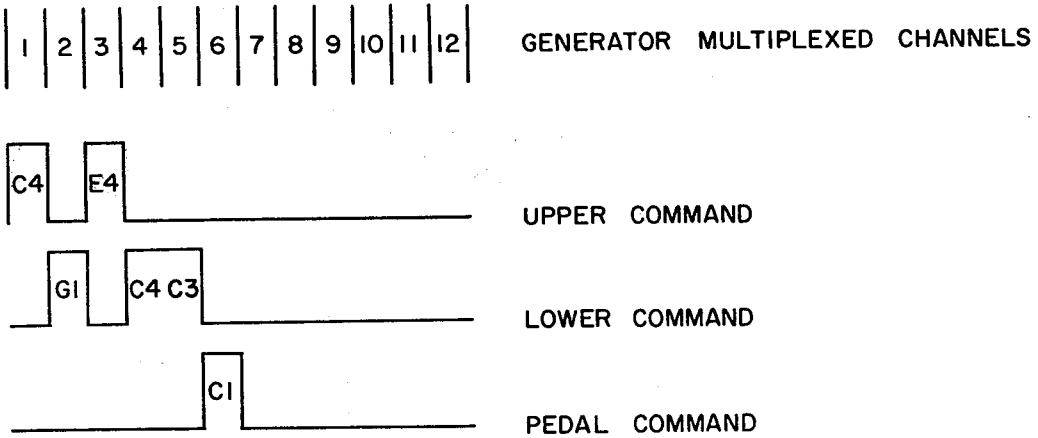
FIG. 5 is a graphic representation of the assignment of note generator channels in a three keyboard musical instrument in accordance with the present invention.
Figure 6:
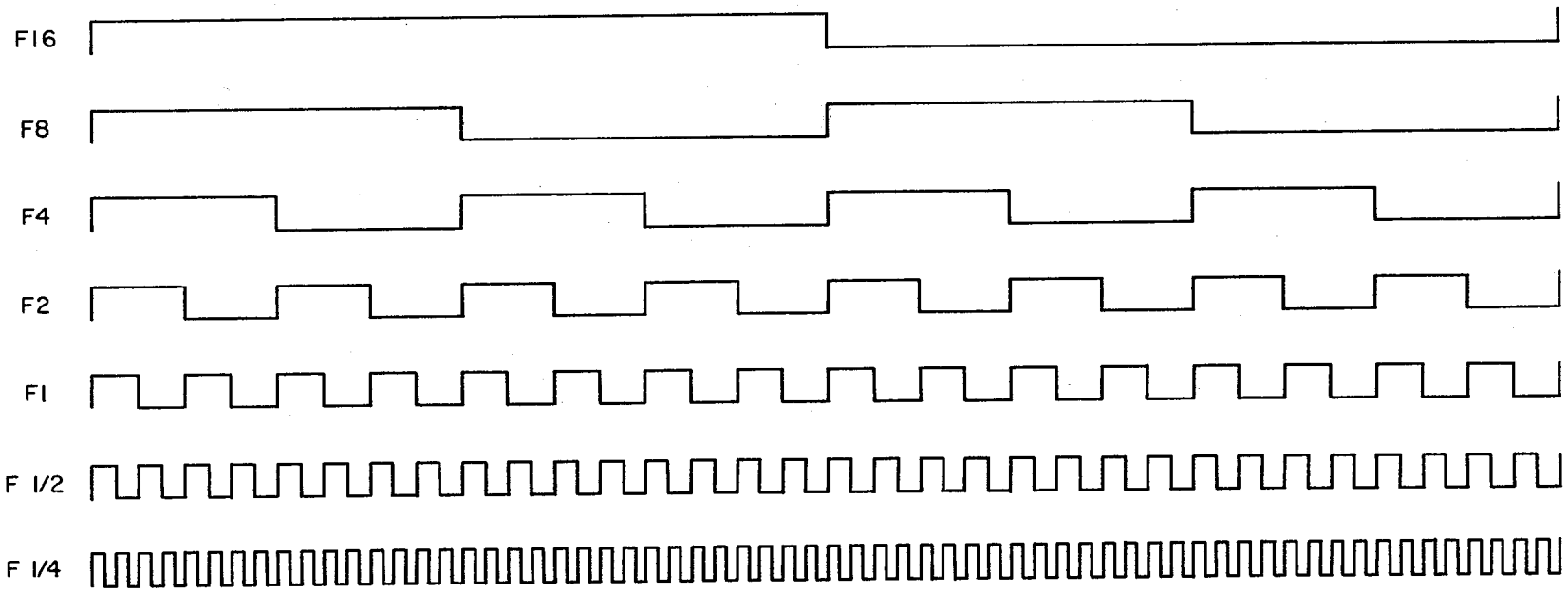
FIG. 6 depicts a demultiplexed view of the octave relationship between the various frequency outputs of the multiplexed accumulator for one channel.

Referring now to the drawings in detail, wherein like numerals indicate like elements, there is shown in FIG. 1 a schematic diagram, in block form, of an electronic musical instrument embodying the present invention. Electronic musical instruments or digital electronic musical instruments in which the present invention may be applied and used are described in detail in U.S. Pat. Nos. 3,610,799 and 3,639,913, of which the inventor was George A. Watson. Reference may be had to these patents for detailed descriptions of components referred to herein other than the demultiplexing audio waveshape generator producing structural relationships in accordance with the invention. In FIG. 1 there is shown a keyboard 10 composed of a plurality of key switches or keys. The key switches or keys are used in the generic sense and will be referred to herein as keys, being the keys of various electronic musical instruments. The activity of a key on keyboard 10 is encoded in a time-division multiplexed format by keyboard encoder 12. The multiplexed signal encoded by keyboard encoder 12 is presented to generator assignment logic 14. The function of generator assignment logic 14 is to capture a multiplexed channel of the demultiplexing audio waveshape generator 24 in behalf of the active key as indicated by the multiplexed encoding signal from keyboard encoder 12. The time division relationship between the multiplexed signal of encoder 12 and the multiplexed channels of demultiplexing audio waveshape generator 24 may be graphically depicted as in FIG. 4. By reference to FIG. 4, it can be seen that each individual key of keyboard 10 is allocated a time slot typically of 12 $\mu$ seconds and that the demultiplexing audio waveshape generator typically has twelve multiplexed channels, each channel being allocated a time slot of 1 $\mu$ second. Therefore, during the time slot period of any key there are twelve individual multiplexed channels available for capture. This time relationship is represented graphically in FIG. 5 for a three keyboard electronic musical instrument with a total of six activated keys. If the six keys are activated on the respective keyboards in the following order: upper C4, lower G1, upper E4, lower C4 and C3, and pedal C1, the generator assignment logic 14 will capture the channels as shown in FIG. 5. The information will repeat each cycle until the respective key is deactivated whereupon the generator assignment logic 14 will free the associated channel and that channel becomes available for capture. The above brief description of generator assignment logic 14 is more fully explained in U.S. Pat. No. 3,610,799. Referring again to FIG. 1, phase angle calculator 16 calculates phase angle numbers in synchronism with keyboard pulse time slots. The calculation of the phase angle may be done as a function of the frequency of the note to be reproduced. An alternative to calculating the phase angle is a conventional memory with look-up capabilities or simply a memory from which the correct phase angle is extracted when suitably addressed. A combination of a memory with look-up capabilities and of a calculator capable of computing the phase angle may be employed. The phase angle generated, regardless of how generated, is gated through gate 18 in response to the gate enabling signal from generator assignment logic 14. The enabling signal from assignment logic 14 coordinates the loading of the appropriate phase angle numbers into multiplexed phase angle register 20 at the time slot position corresponding to the demultiplexing audio waveshape generator channel as described above. The multiplexed phase angle register 20 has a capacity to hold a phase angle number for each individual channel of the waveshape generator. Each number stored in the multiplexed phase angle register 20 is added to its respective channel in the multiplexed accumulator 22 every complete cycle of the demultiplexed audio waveshape generator channels or typically every 12 $\mu$ sec. The individual totals in the accumulator channels increase in magnitude at a rate proportional to their respective phase angle numbers. The values of the phase angle numbers are chosen such that a preselected bit position of the multiplexed accumulator 22 will toggle at the desired eight (8) foot musical frequency corresponding to the key assigned that waveshape generator channel by the generator assignment logic 14. Since the bit positions of the multiplexed accumulator 22 are related in a binary fashion, higher frequencies and lower frequencies, which are octavely related to the eight foot bit position, are available at the other bit positions within the selected channel. FIG. 6 depicts a demultiplexed view of the octave relationship between the various frequency outputs of the multiplexed accumulator for one channel of the waveshape generator. Thus F8 corresponds to the 8 foot musical frequency, F4 to the 4 foot musical frequency, and etc. It can be seen from FIG. 6 that due to the octave relationship each successively higher footage results in a frequency one-half of that immediately preceding lower footage. Within each and every channel of the waveshape generator, these several musical frequencies are individually presented at the corresponding bit position. Therefore, a number of octavely-related musical frequencies are available at different bit positions within a single multiplexed channel of the waveshape generator.

Figure 2:
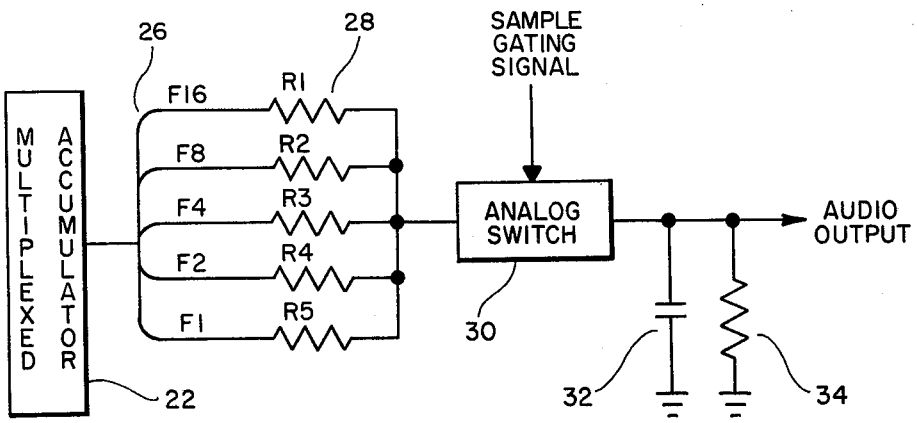
FIG. 2 is a schematic diagram of the preferred embodiment in accordance with the present invention.

Referring again to FIG. 1, the multiplexed frequency signals of the multiplexed accumulator 22 are accepted by the demultiplexing audio waveshape generator 24. Referring now to FIG. 2, a schematic diagram of the demultiplexing audio waveshape generator 24, it can be seen that the time-division multiplexed frequency signals 26 are presented such that the F8 or eight (8) foot musical frequency bit of each channel is presented to resistor R2 in time-division multiplexed fashion. The F16 or sixteen (16) foot musical frequency bit of each channel is presented to resistor R1 and so on until each selected musical frequency bit has been presented to a resistor. Typically every 1 $\mu$ second a channel containing multiplexed musical frequency information will be presented to the audio generator input, thus, assuming a twelve channel system, a complete demultiplexing audio waveshape generator cycle will typically repeat every 12 $\mu$ seconds. The multiplexed signals 26 drive current through the respective weighting resistors 28 whereby a contribution proportional to the value of the resistor and the instantaneous driving voltage is made to the current flow through analog switch 30. Analog switch 30 is readily available standard component, e.g. RCA part CD 4016A E.

The function of analog switch 30 is to select the demultiplexing audio waveshape generator channels which are to be combined to form the audio waveshape output. The selection of the required channels is made in response to the sample gating signals from generator assignment logic 14. As stated above, the generator assignment logic 14 will capture a channel in response to keyboard activity. The capture of a channel by generator assignment logic 14 also results in a sample gating signal which is coordinated in time therewith. It can therefore be seen that only those channels which have been captured by the generator assignment logic 14 in response to keyboard 10 activity will make a contribution to the audio waveshape output. When upon command of the sample gating signal analog switch 30 is closed, a current, which is proportional to the weighting resistors 28 and the state of the respective frequency signals 26 driving the resistors, flows into the capacitor-resistor combination 32 and 34 resulting in a voltage increment on the capacitor 32 corresponding to the desired contribution of that channel to the audio waveshape at that particular instant in time. If more than one channel is selected in response to the sample gating signal each selected channel will contribute its own voltage increments to the composite audio waveshape output.

Capacitor-resistor combination 32 and 34 also forms a low-pass filter with respect to the audio tone. The characteristics of this filter may be selected using standard procedures to obtain the desired final audio output tone.

Figure 3:
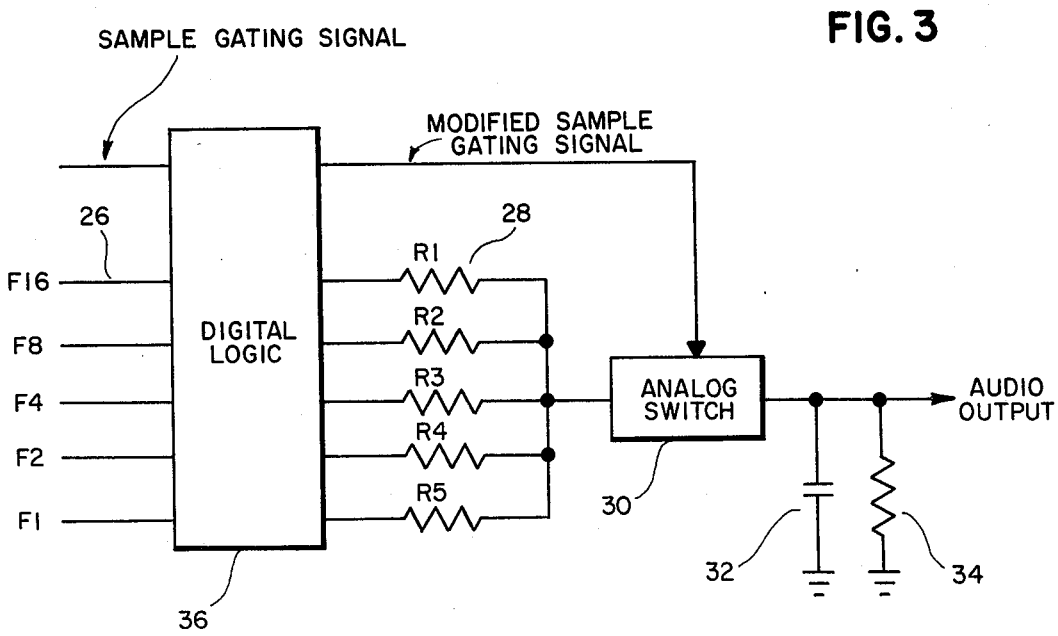
FIG. 3 is a schematic diagram, partially in block diagram form, of an alternate arrangement employing digital logic of the preferred embodiment in accordance with the present invention.
Figure 7:
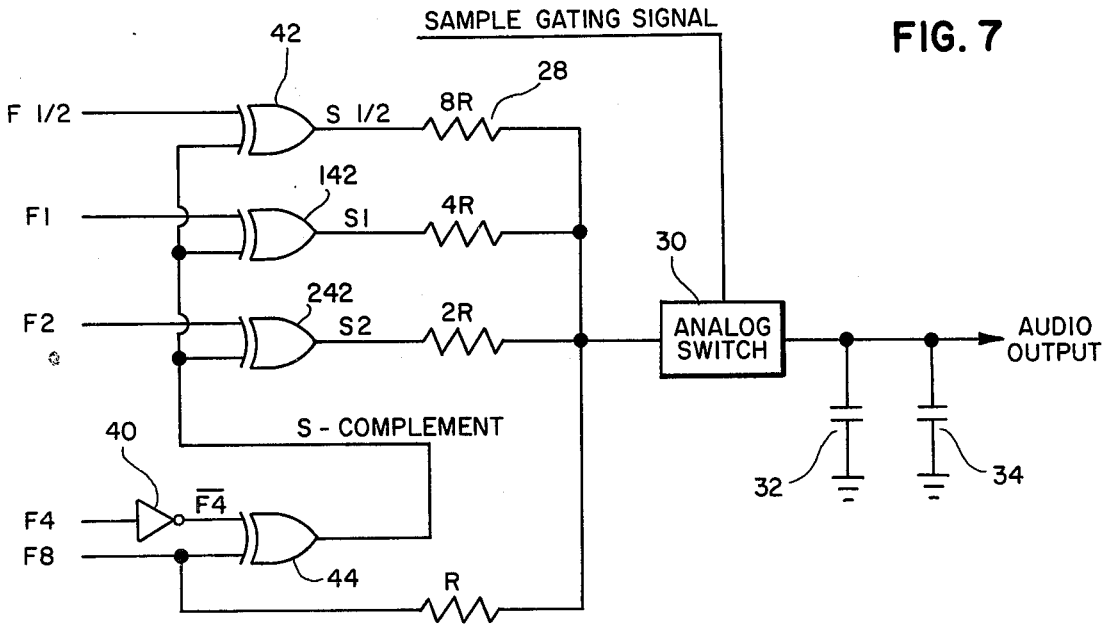
FIG. 7 is a schematic diagram of a demultiplexing audio waveshape generator in accordance with the present invention for obtaining a triangular waveshape useful for flute tones.
Figure 8:
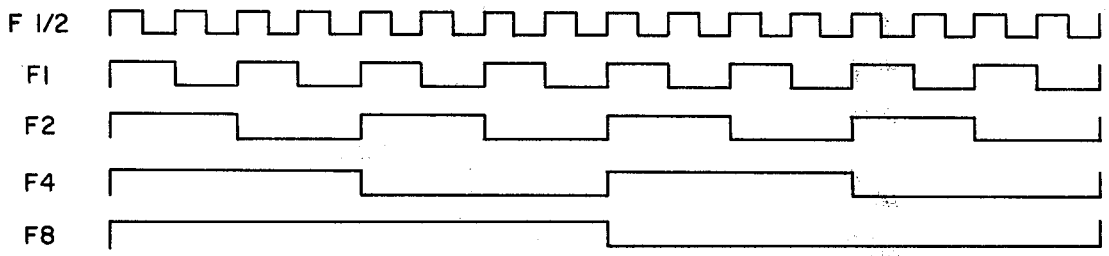
FIGS. 8, 8A, 8B graphically represent the frequency signals used in the demultiplexing audio waveshape generator of FIG. 7.
Figure 8A:
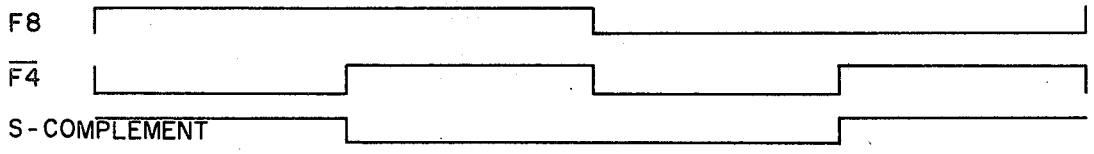
Figure 8B:
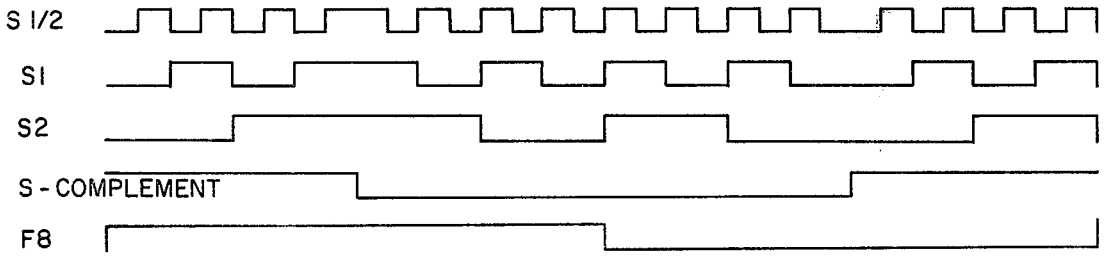

Referring to FIG. 3, there is shown digital logic 36 with a demultiplexing audio waveshape generator in accordance with the present invention. The digital logic 36 may be applied to any one or all of the inputs to the demultiplexing audio waveshape generator. As will be described hereinafter, the precise arrangement of the digital logic 36 will vary with the tonal requirement of the generator. FIG. 7 shows one arrangement, in schematic form, for obtaining a triangular waveshape, useful for flute tones, in accordance with the principles of the present invention. It is understood that this arrangement may be expanded or abbreviated according to desired tonal design without departing from the essence of the arrangement as shown. For the benefit of the explanation of this arrangement the resistors R, 2R, 4R and 8R are binary weighted and have respective values of 10K, 20K, 40K and 80K. FIG. 8 is a graphic representation of the frequency signals produced by multiplexed accumulator 22 of FIG. 1. FIG. 8A is a graphic representation of the inputs and output of exclusive —OR gate 44. FIG. 8B is a graphic representation of the signals used to generate the desired audio waveshape. Referring to FIG. 7 it can be seen that the multiplexed frequency signal F4 is inverted through inverter 40 and that the output F4 is applied to one input of exclusive —OR gate 44. The multiplexed frequency signal F8 is applied to the other input of exclusive —OR gate 44 and as a result of the function of exclusive —OR gate 44 the signal S-complement is produced, see FIG. 8A. The signal S-complement is then applied to one input of each of the individual exclusive —OR gates 42, 142 and 242. The multiplexed frequency signals output by the multiplexed accumulator 22 of FIG. 1 are applied to the other input of their respective exclusive —OR gate 42. The modified frequency signals $S\frac{1}{2}$, S1 and S2 are produced by exclusive —OR gate 42, 142 and 242 as the driving signal for their respective resistors. These signals along with the F8 frequency signal pass through the respective weighting resistors 28 and contribute to the desired waveshape in the same manner as described above.

Figure 9:
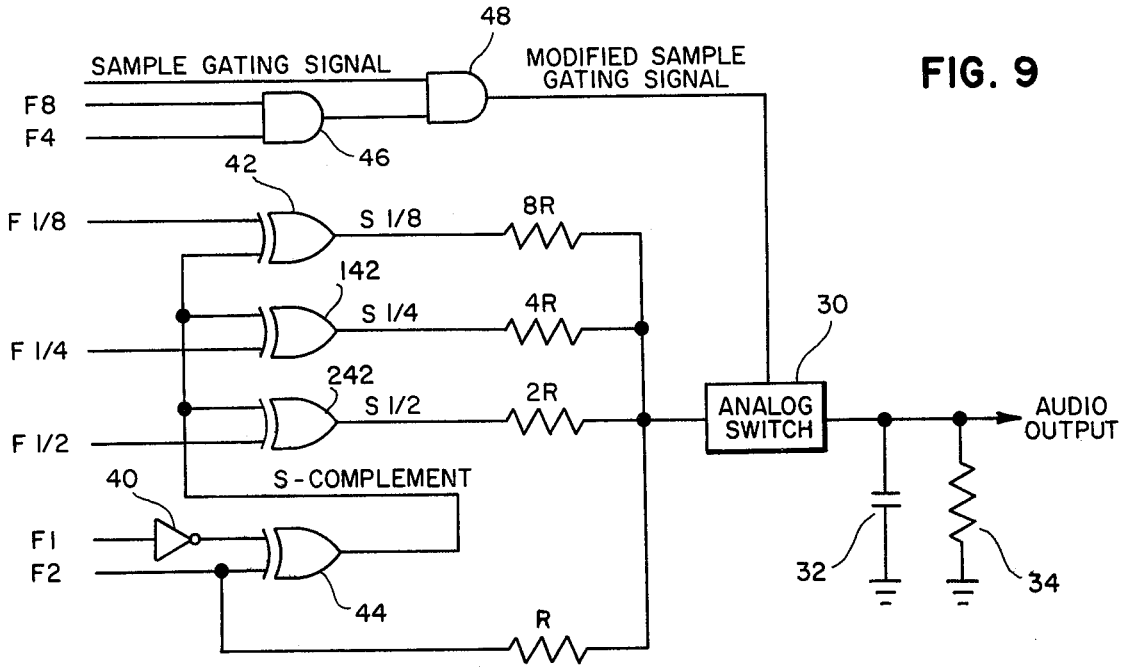
FIG. 9 is a schematic diagram with digital logic of a demultiplex audio waveshape generator in accordance with the present invention for obtaining a pulsed waveshape useful for reed tones.

A pulsed waveshape useful for reed tones may be generated by modifying the above described sample gating signal. FIG. 9 shows a triangular waveshape generator with modifying logic. The basic waveshape generator as shown functions in precisely the manner as described above for a triangular waveshape generator. Referring to FIG. 9 it can be seen that the multiplexed frequency signals F8 and F4 are applied to the input of AND gate 46. The output of AND gate 46 is applied to one input of AND gate 48 and the sample gating signal is applied to the other input of AND gate 48 resulting in a modified sample gating signal. As a result of AND gate logic, AND gate 46 will only have an output when both the F4 and F8 signals are high and AND gate 48 will only have an output when both the inputs of AND gate 48 are high. Therefore, the pulse width of AND gate 46 output will only be one-fourth ($\frac{1}{4}$) the pulse width of the multiplexed frequency signal F8 and the sample gating signal will be correspondingly modified to only permit the propagation of a waveshape segment equal to AND gate 46 pulse width.

Figure 10:
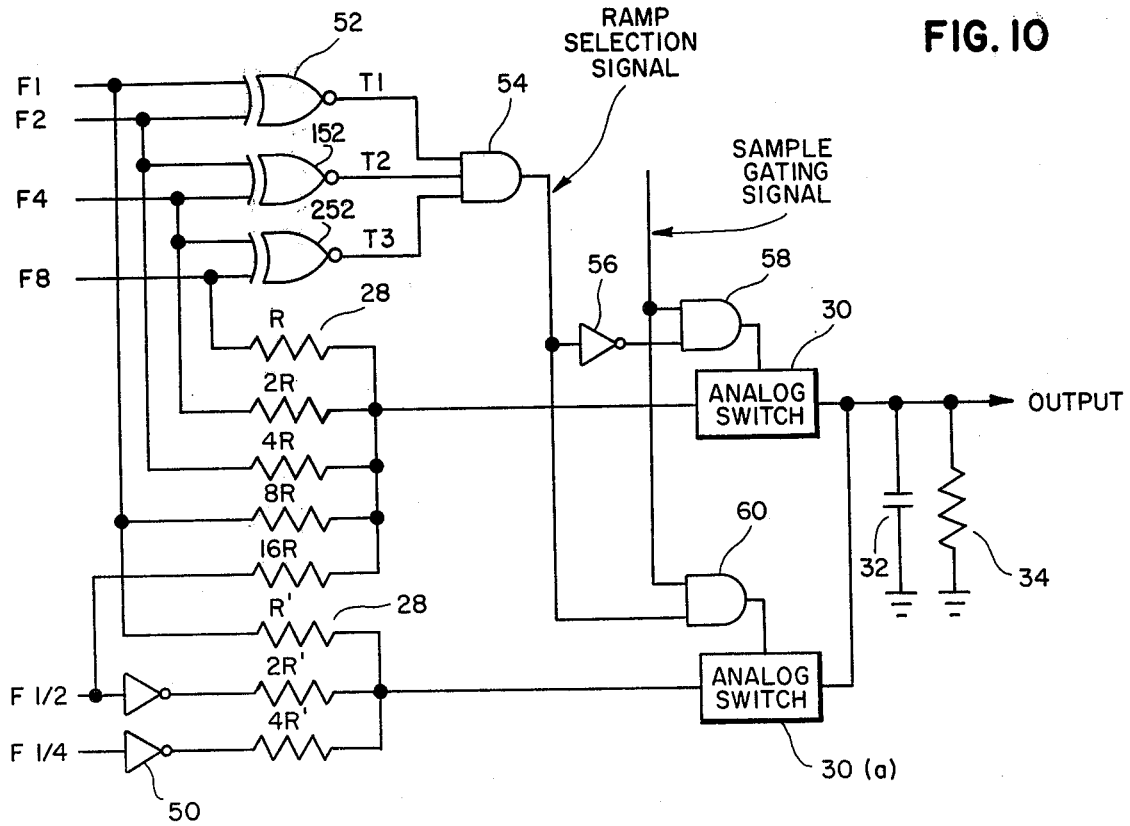
FIG. 10 is a schematic diagram with digital logic of a demultiplexing audio waveshape generator in accordance with the present invention for obtaining a modified sawtooth waveshape useful for string tones.
Figure 11:
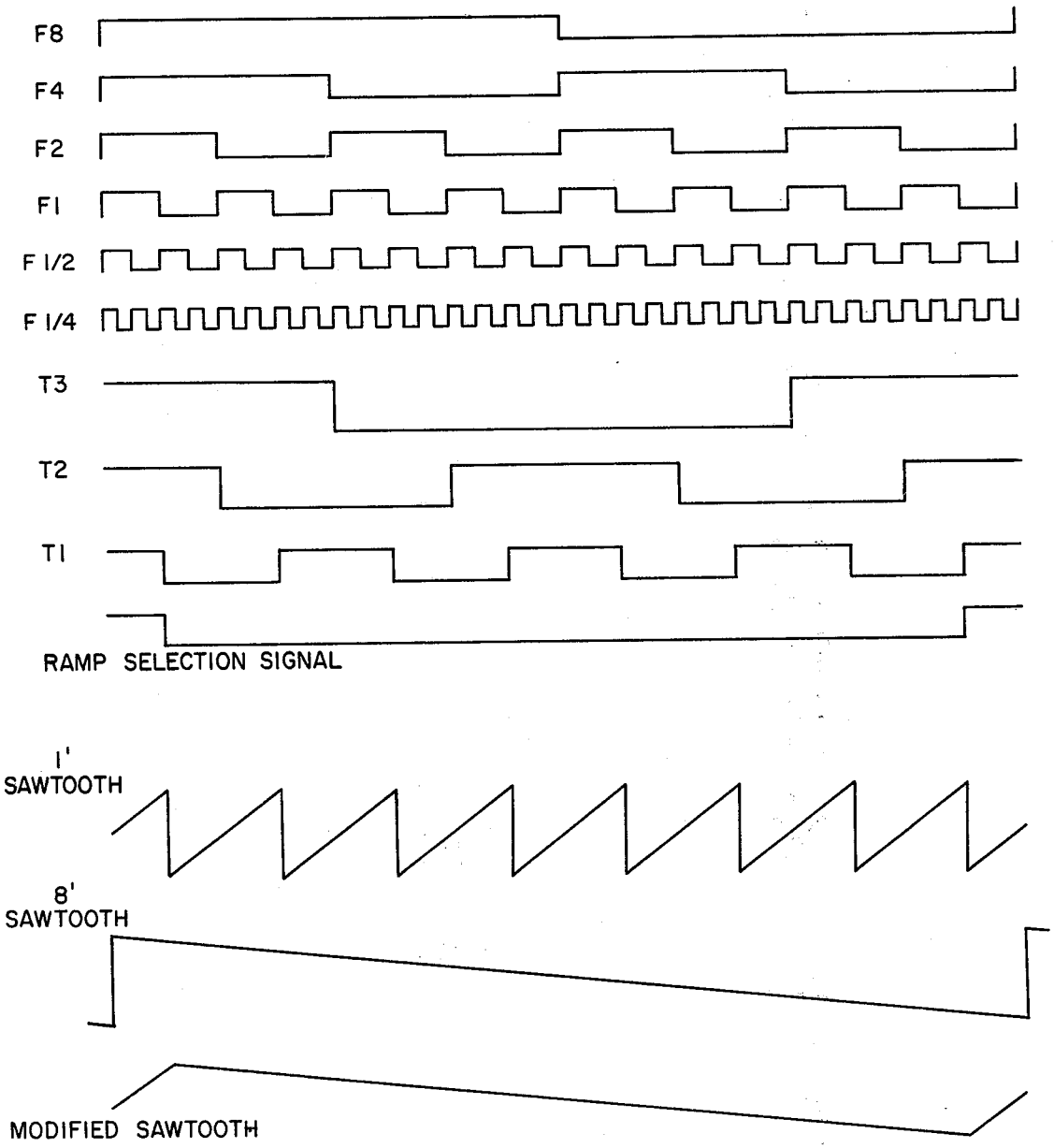
FIG. 11 is a graphic representation of the frequency signals used in the demultiplexing audio waveshape generator of FIG. 10.

FIG. 10 shows an arrangement of sawtooth waveshape generators, in accordance with the present invention, and digital logic for obtaining a combined waveshape useful in string tones. Since the waveshape generator of FIG. 10 functions, in accordance with the invention, as explained above, it is the digital logic which is of interest in the arrangement. The multiplexed frequency signal $F\frac{1}{2}$ and $F\frac{1}{4}$, from multiplexed accumulator 22 of FIG. 1, are inverted through invertors 50 before being applied to resistors 2R′ and 4R′. The function of this inversion is to obtain a 1 foot frequency sawtooth ramp with a direction opposite to and in synchronization with the 8 foot frequency sawtooth ramp of the more expansive sawtooth generator in the arrangement. The 1 foot generator functions as explained above with the output of the resistors R′, 2R′, and 4R′ being connected in common to analog switch 30 (*a*). The multiplexed frequency signals F1, F2, F4 and F8 from multiplex accumulator 22 of FIG. 1 are applied to their respective resistors of the second waveshape generator to the arrangement and to the respective inputs of the exclusive —NOR gates 52, 152, and 252. As shown in FIG. 10, the input of any one of the gates 52, 152, and 252 are the two octavely related frequency signals which are one octave apart. Thus F1 and F2 are applied to the same gate. F2 and F4 are applied to another and so on. As a function of the exclusive —NOR gates 52, 152 and 252 the signals T1, T2, and T3, as shown in FIG. 11, are applied to AND gate 54. The output of AND gate 54 is the ramp selection signal. The multiplexed frequency signals, from multiplex accumulator 22 of FIG. 1, are applied to the resistors of the 8 foot generator in the same manner as described above and result in the signal applied to its respective analog switch 30. The ramp selection signal is used in conjunction with digital logic and the sample gating signal to control the function of the respective generator analog switches. The ramp selection signal and the sample gating signal are applied to the inputs of AND gate 60. The output of AND gate 60 is a selective sample gating signal for commanding the closure of analog switch 30 (*a*) of the reverse ramp sawtooth generator. The ramp selection signal is inverted by inverter 56 before being applied along with the sample gating signal to AND gate 58. The output of AND gate 58 is a selective sample gating signal for commanding the closure of analog switch 30 of the sawtooth generator. Therefore, as can be seen by reference to FIG. 11, the ramp selection signal will choose the 1 foot generator waveshape when the ramp selection signal is high and the 8 foot generator waveshape when the ramp selection signal is low. Since the two analog switches 30 and 30 (*a*) are connected in common the current on the capacitor-resistor combination 32 and 34 is as described above.

The specific arrangements in accordance with the instant invention which are described hereinabove are not to be interpreted as in any way limiting the scope of the claimed invention. Rather, these precise arrangements have been described in an effort to more fully disclose the use of the present invention in various embodiments. Additionally, it is noted that some deviation from strict binary weighting of the resistors used in the present invention may be useful to achieve specific design objectives. The variation of resistor weighting and the expansion or contraction of the demultiplexing audio waveshape generator are design considerations and do not alter the principles of the disclosed invention. Thus, the present invention may be embodied in other specific forms without departing from the spirit of the essential attributes thereof, and accordingly, reference should be made to the appended claims rather than to the foregoing specifications as indicating the scope of the invention.

I claim:

1. In a method of generating an audio waveshape wherein octavely related multiplexed frequency signals are generated by a multiplexed accumulator in respect to a preselected number of waveshape generator channels and wherein a sample gating signal is generated to select at least one of said channels, the steps of:

weighting each of said plural multiplexed octavely related frequency signals, selectively combining the plural weighted frequency signals in response to said sample gating signal, and smoothing the combined weighted frequency signals.

2. The method of claim 1 wherein said step of weighting said frequency signals includes weighting said plural multiplexed octavely related frequency signals according to a binary code.

3. The method of claim 1 including the step of modulating said plural multiplexed octavely related frequency signals.

4. The method of claim 3 including modifying said sample gating signal in accordance with preselected ones of said plural multiplexed octavely related frequency signals.

5. In an electronic musical instrument having means for producing plural multiplexed octavely related frequency signals in respect to a preselected number of waveshape generator channels, and means for producing a sample gating signal for selecting at least one of said channels, a demultiplexing audio waveshape generator, comprising:

a plurality of interconnected weighting resistors connected to said means for producing said plural multiplexed octavely related frequency signals for weighting each of said plural multiplexed frequency signals, an analog switch connected to each of said weighting resistors and said means for producing a sample gating signal for selectively combining said plural frequency signals weighted by said resistors in response to said sample gating signal, and a capacitor and a resistor connected to said analog switch for smoothing said weighted frequency signals combined by said analog switch.

6. The demultiplexing audio waveshaped generator in accordance with claim 5 including digital logic circuitry connected between said means for producing said plural multiplexed octavely related frequency signals and said weighting resistors for modulating said plural multiplexed octavely related frequency signals.

7. The demultiplexing audio waveshape generator in accordance with claim 6 including means connected to said analog switch and preselected ones of said plural multiplexed octavely related frequency signals for modifying said sample gating signal in accordance with said preselected multiplexed frequency signals.

8. An electronic musical instrument, comprising:

means for selecting the notes of a musical scale, multiplexed generating means having plural channels for generating plural octavely related frequency signals associated with each of said channels, assignment means responsive to said note selection means for generating a sample gating signal to assign a channel of said multiplexed generating means to a selected note, a plurality of interconnected weighting resistors for producing plural weighted frequency signals in response to said plural octavely related frequency signals, an analog switch connected to each of said resistors for selectively combining said plural weighted frequency signals in response to said sample gating signal, and a capacitor and a resistor connected to said analog switch for smoothing said weighted frequency signal combined by said analog switch.

9. The demultiplexing audio waveshape generator in accordance with claim 8 wherein said weighting resistors are binary weighted.

10. The demultiplexing audio waveshape generator in accordance with claim 8 including digital logic circuitry connected between said multiplexed generating means and said weighting resistors for modulating said plural octavely related frequency signals.

11. The demultiplexing audio waveshape generator in accordance with claim 10 including means connected to said analog switch and preselected ones of said plural multiplexed octavely related frequency signals for modifying said sample gating signal in accordance with said preselected multiplexed frequency signals.

* * * * *